US007047577B1

(12) United States Patent
Cirilli

(10) Patent No.: US 7,047,577 B1
(45) Date of Patent: May 23, 2006

(54) PORTABLE SHOWER STALL FOR INVALIDS

(76) Inventor: Carlo Cirilli, 1 Valmere Ct., Edison, NJ (US) 08817

( * ) Notice: Subject to any disclaimer, the term of this patent is extended or adjusted under 35 U.S.C. 154(b) by 0 days.

(21) Appl. No.: 11/143,438

(22) Filed: Jun. 3, 2005

(51) Int. Cl.
*A47K 3/22* (2006.01)
*A47K 3/32* (2006.01)

(52) U.S. Cl. ..... 4/599; 4/603; 4/605

(58) Field of Classification Search ..... 4/596, 4/599, 600, 602, 603, 605, 613, 615
See application file for complete search history.

(56) References Cited

U.S. PATENT DOCUMENTS 3,080,568 A * 3/1963 Burnett ..... 4/602
4,413,363 A * 11/1983 Troiano ..... 4/599
4,975,992 A 12/1990 Patterson et al.
5,205,001 A 4/1993 O'Connell
5,790,992 A 8/1998 Ray
6,389,617 B1 5/2002 Hartline et al.
6,802,088 B1 10/2004 Gruner

* cited by examiner

*Primary Examiner*—Tuan Nguyen
(74) *Attorney, Agent, or Firm*—Thomas J. Germinario

(57) ABSTRACT

A portable shower stall is disclosed having a basin panel and back panel hingeably connected together so as to form a suitcase-like enclosure in the closed position. Within the enclosure are stored the shower stall components. When assembled, the shower stall consists of a self-enclosing shower curtain suspended from a curtain rod which is supported by four segmented vertical poles secured in sockets in the basin panel. Water is conveyed from a faucet to a shower head and a sump-pump discharges waste water to a sink or bathtub.

14 Claims, 3 Drawing Sheets

PORTABLE SHOWER STALL FOR INVALIDS

BACKGROUND OF THE INVENTION

People who care for incapacitated individuals are faced with the problem of bathing the patient in a manner compatible with his/her disabilities. Since many invalids are unable or unwilling to use a conventional shower facility, it is desirable to have a portable shower stall which can be brought to the patient and quickly assembled in a manner that does not unduly alarm the invalid or tax his/her patience. Such a portable shower stall should also be designed so that the caregiver can remain outside the shower enclosure while still directing the shower head and having access to the patient to scrub him/her.

A portable shower stall for invalids may be employed in either an institutional or home setting. Therefore, it should be designed to be used in conjunction with a nearby water faucet and sink, with the former serving as a water source and the latter serving as an outlet for waste water. It is also desirable that the portable shower stall be collapsible into a compact configuration that can be conveniently stowed away when the shower is not in use.

The present invention addresses the foregoing needs in a manner which represents a significant improvement over the prior art. In the prior art we find several patents directed to wheeled bed-baths (e.g., Morcate et al., U.S. Pat. No. 5,678,257, Oct. 21, 1997; Gruner, U.S. Pat. No. 6,802,088 B1, Oct. 12, 2004) or wheeled showering cabinets (e.g., Queen et al., U.S. Pat. No. 5,978,983, Nov. 9, 1999). These inventions are designed to accommodate bed-ridden and non-ambulatory patients, but they are not particularly suited for use by an ambulatory invalid, such as an Alzheimer's or stroke patient. Indeed, in the case of an ambulatory mentally incapacitated patient, it may be more problematic to get them into a bed-bath or showering cabinet than to get them into a conventional shower. Moreover, these inventions have the disadvantage of not being collapsible and require considerable space for storage when not in use.

Portable shower designs which provide for varying degrees of disassembly and compact storage are disclosed in Davies, U.S. Pat. No. 4,866,794, Sep. 9, 1989, Ray, U.S. Pat. No. 5,790,992, Aug. 11, 1998, and Zhou, U.S. Pat. No. 6,745,414 B2, Jun. 8, 2004. But these inventions are designed for use in an outdoor or industrial setting and are not suitable for indoor institutional or home use. They are not designed to be used in conjunction with a water faucet and sink. They are also not particularly suitable for use by caregivers of invalid patients, since they lack the means for a caregiver to remain outside the shower enclosure while directing the shower spray onto a patient.

While both portable and collapsible, the shower apparatus taught by Hartline et al., U.S. Pat. No. 6,389,617 B1, May 21, 2002, is primarily designed for use in the cab of a truck or a tractor-trailer and thus provides for its own internal water supply tank and water disposal tank. Therefore, this design is unduly complex and cumbersome because it does not take advantage of the availability of running water and sinks in the institutional or home setting. It also lacks the means for a caregiver to remain outside the shower enclosure while bathing the patient.

O'Connell, U.S. Pat. No. 5,205,001, Apr. 27, 1993, is directed to a portable collapsible shower enclosure accommodating an invalid person. But it is not self-supporting and requires an overhead point of suspension, which may not be available in an institutional or home setting. It is also designed to be used with the caregiver being inside the shower enclosure with the patient.

Patterson et al., U.S. Pat. No. 4,975,992, Dec. 11, 1990, teaches a portable shower stall which collapses into a suitcase-like enclosure for convenient storage. It also utilizes a shower and sump arrangement connected to a nearby sink. The shower stall can be quickly assembled by inserting vertical support members into the base of the suitcase-like enclosure. Supported by these vertical members is a ceiling panel from which the showerhead and the shower curtain are suspended. While this design is well suited for a non-invalid person, such as a traveler, who is capable of showering him/herself, the ceiling panel obstructs the access of the caregiver to the interior of the shower stall and interferes with the caregiver's ability to reach inside the shower stall to direct the shower spray and wash the patient.

The present invention represents a substantial improvement over the prior art with respect to a portable, stowable shower stall designed for use by a caregiver in washing an invalid in a home or institutional setting. Like the design disclosed in Patterson et al., U.S. Pat. No. 4,975,992, the present invention teaches the use of a very portable suitcase-like enclosure in which the components of the shower stall are stored when not in use. Like the Patterson design, the present invention also utilizes a faucet-connected showerhead and a sump in the basin panel of the suitcase-like enclosure which discharges to a sink.

Also like the Patterson design, the present invention employs collapsible vertical poles to form the shower stall. But unlike the Patterson design, in the present invention the back panel of the suitcase-like enclosure does not detach to form the ceiling panel of the shower stall, but instead remains hingeably attached to the basin panel to form a partial back wall for the shower stall. Instead of having a ceiling panel, the top of the shower stall remains open in the present invention. A shower curtain rod attachable to the top of the vertical poles supports a shower curtain, which completes the shower enclosure. Instead of being affixed to a ceiling panel, the shower head in the present invention is designed to be held and directed by the caregiver outside the shower enclosure. The shower head may be temporarily hooked or clipped to any position on the shower curtain rod in order to free the hands of the caregiver for washing the patient.

One of the great advantages of the present invention is that the shower stall can literally be assembled and disassembled around the patient as he/she stands or sits on the floor of the basin panel. This eliminates the difficult task of trying to move an uncooperative or disoriented patient into and out of a pre-established shower stall. Consequently, the present invention is ideally suited to the task of showering a mentally impaired or disturbed patient in the institutional or home setting.

SUMMARY OF THE INVENTION

The present invention is a portable shower stall designed to be used by a caregiver in bathing an invalid who is unable or unwilling to use a conventional shower. The portable shower is configured to allow the caregiver to remain outside the shower enclosure while directing a shower spray onto the patient and washing him/her. Its water source is a conventional faucet, and it discharges its waste water through a sump to a conventional sink or bath tub. The portable shower is self-supporting and collapsible into a compact form for convenient storage when not in use.

A portable shower having the features of the present invention comprises a basin panel consisting of a rectangular water-tight enclosure having a flat bottom, which acts as the floor of the shower stall, and four vertical walls. Hingeably attached to the rear wall of the basin panel is a back panel which, when raised, functions as a partial back wall of the shower stall. When lowered, the back panel forms a suitcase-like enclosure with the basin panel.

In the corners of the basin panel are located four basin sockets into which are inserted four vertical poles. Each of the four vertical poles consists of two or more segments which can be disassembled for compact storage within the suitcase-like enclosure. The upper end of each vertical pole contains a means, such as a hook or a socket, for attaching it to a shower curtain rod, which connects the upper ends of the four vertical poles, and which may be annular or rectangular in shape. The shower enclosure is completed by suspending a shower curtain from the shower curtain rod by hooks or rings inserted through eyelets in the top of the shower curtain, as is typical in conventional shower stalls.

In the preferred embodiment, a shower head is connected through a shower hose to a sump-pump located in one corner of the basin panel. In this case, the sump-pump may be driven either by an internal electrical motor or by the incoming water pressure from a faucet, which enters the sump-pump through an inlet hose. Alternately, the shower head may be connected through the shower hose directly to the faucet, in which case the sump-pump must be driven by an internal electric motor. Waste water which collects in the bottom of the basin panel during the showering operation is discharged by the sump-pump to a sink or bathtub through an outlet hose. To insure that the waste water flows toward the corner of the basin panel where the sump-pump is located, adjustable leveling supports are provided in the other three corners of the basin panel.

The shower hose is long enough to extend above the level of the shower curtain rod in order to permit the caregiver to direct the spray from the shower head into the shower enclosure without drawing the curtain aside. The caregiver may regulate the intensity of the shower spray and turn it on and off using a control button or knob on the shower head. When the caregiver needs to free his/her hands to wash the patient, the shower head may be suspended from the annular shower curtain rod by a hook or clip attached to the shower head.

The back panel is connected to the rear of the basin panel by two or more hinges, which allow the back panel to be raised to an upright position perpendicular to the basin panel or lowered to form a suitcase-like enclosure with the basin panel. A latch mechanism is provided to hold the back panel and basin panel together in the closed position for transport and/or storage. To facilitate transport of the portable shower stall, a handle is provided on the outside of one of the vertical walls of the basin panel and one or more trundle wheels are affixed to the outer corners on the opposite side of the basin panel. In the upright position, the back panel functions as a partial back wall of the shower stall. Incorporated in the back panel are one or more soap/shampoo holders and towel bars.

These and other features, aspects and advantages of the present invention will become better understood in light of the following description, appended claims and accompanying drawings.

DESCRIPTION OF THE INVENTION

Figure 1:
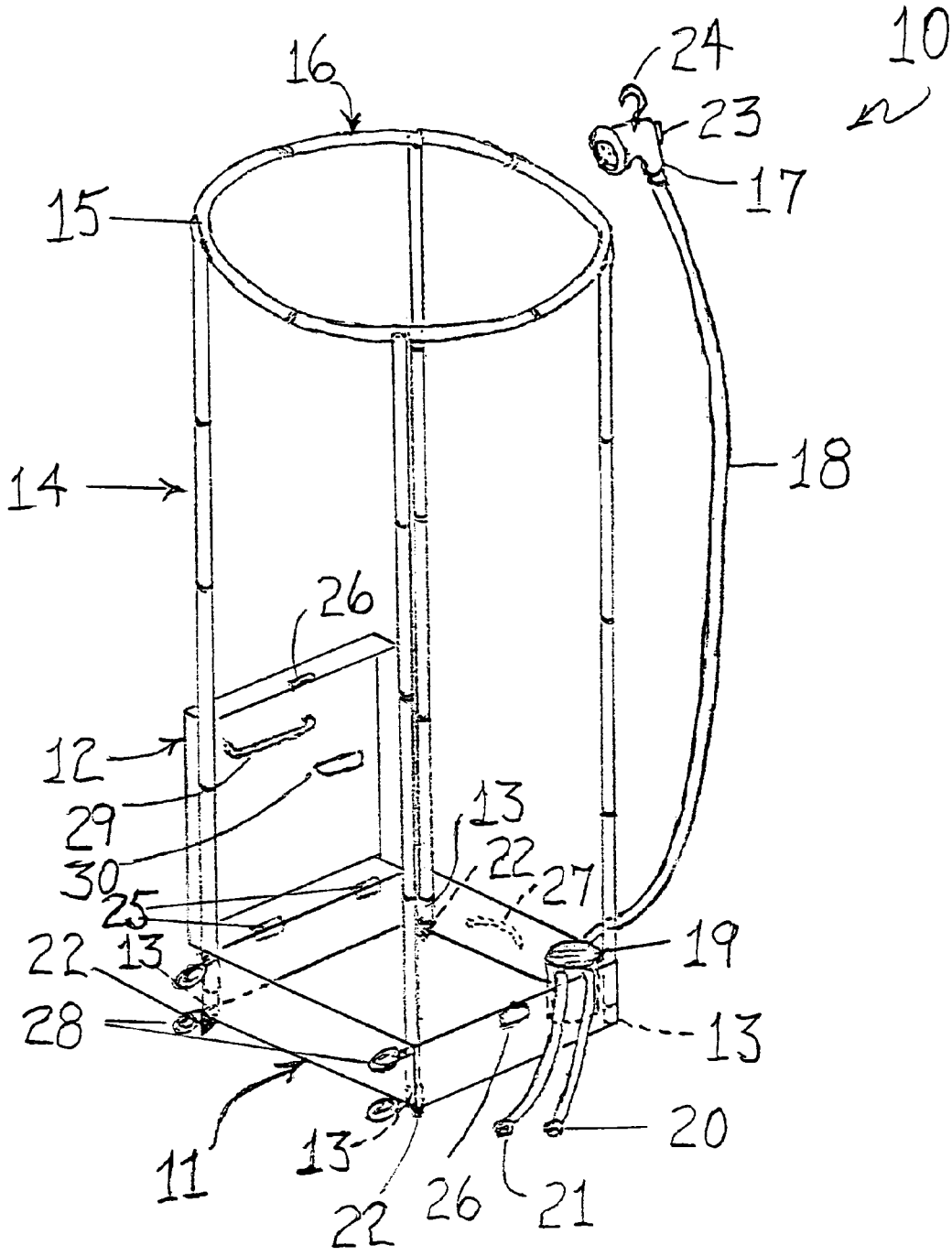
FIG. 1 is an isometric view of the portable shower stall in its expanded form without the shower curtain installed.

FIG. 1 depicts a portable shower stall embodying features of the present invention 10 in fully assembled form but without a shower curtain. A basin panel 11 functions as the floor and bottom enclosure of the shower stall. The basin panel 11 consists of a water-tight rectangular enclosure, fabricated of a durable plastic or metallic material, with a flat bottom and four vertical walls. In the preferred embodiment, the basin panel is 3½ to 4 feet in length, 3 to 3½ feet in width, and 6 to 8 inches in depth.

Figure 3:
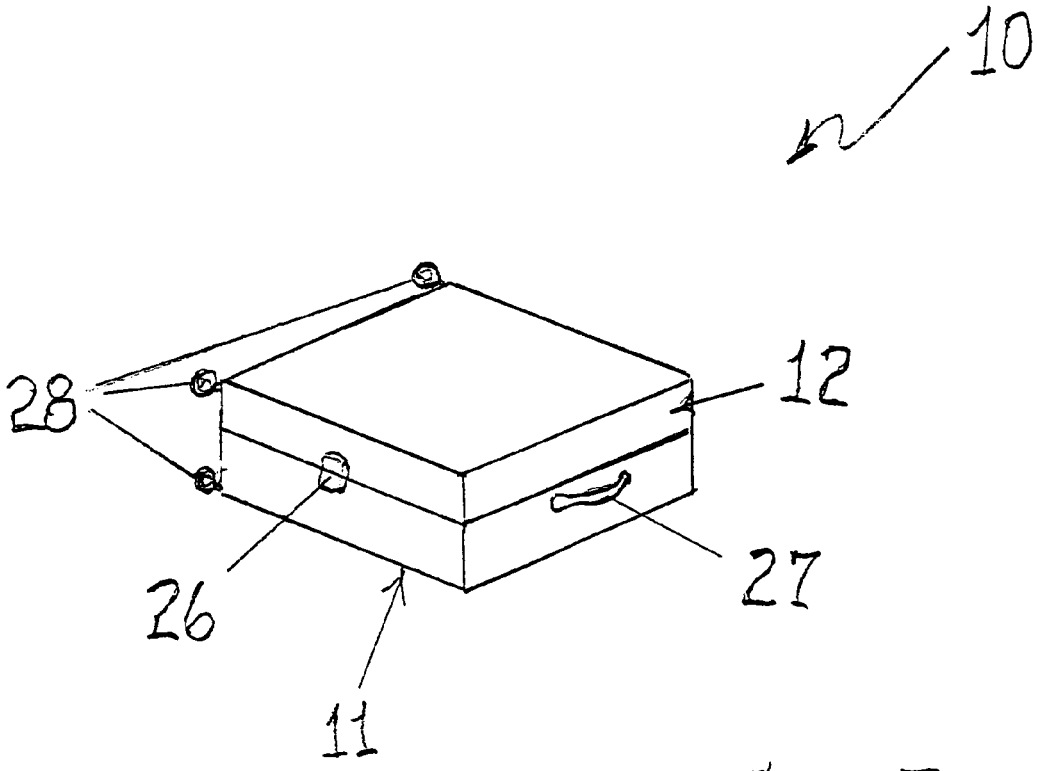
FIG. 3 is an isometric view of the portable shower stall collapsed into its suitcase-like enclosure form.

Hingeably attached to the rear wall of the basin panel 11 is a back panel 12. The back panel 12 consists of a water-tight rectangular enclosure matching the basin panel in shape, material, length and width. When the back panel 12 is in the closed position, as shown in FIG. 3, it forms a suitcase-like enclosure with the basin panel. When the back panel 12 is in the upright position, as shown in FIG. 1, it functions as a partial back wall of the portable shower stall 10. In the preferred embodiment, the back panel 12 has a depth of 4 to 6 inches.

In the four corners of the basin panel 11 are located four basin sockets 13, which have a hollow cylindrical shape. In the preferred embodiment, the basin sockets 13 are 2 to 2½ inches in diameter and 3 to 4 inches in depth. When the portable shower stall is being assembled, four vertical poles 14 are inserted into the four basin sockets 13. The vertical poles 14 comprise two or more segmented tubular members which may be telescoping or may be connected by male-female insert joints or by knuckle-type bending joints. In the preferred embodiment, the tubular members comprising the vertical poles 14 are fabricated of a lightweight rigid metal or plastic material and are 1½ to 2 feet in length and 1½ to 2 inches in diameter. The height of the portable shower stall 10 can be adjusted to the height of the patient, or to accommodate a seated patient, by changing the number of tubular members comprising the vertical poles 14. When the portable shower stall 10 is disassembled, each of the vertical poles 14 is broken down into its tubular members, or said members are telescoped together, for compact storage in the suitcase-like enclosure formed when the back panel 12 is in the closed position, as shown in FIG. 3.

On the uppermost segment of each of the four vertical poles 14 is an attachment means, such as a hook or a socket 15, formed to connect to and support a shower curtain rod 16. In the preferred embodiment, the shower curtain rod 16 is rectangular, circular or elliptical in shape, comprising one piece or, alternately, two or more tubular segments which terminate in male-female joints insertable into each other. In the preferred embodiment, the shower curtain rod 16 is fabricated of a light-weight rigid metal or plastic and, in its assembled form, is 4½ to 5 feet in diameter.

In the preferred embodiment, a shower head 17 is connected through a shower hose 18 to a sump-pump 19 located in one corner of the basin panel 11. In this configuration, the sump-pump 19 is connected to a water source, typically a faucet (not shown), through an inlet hose 20. Alternately, the shower head 17 may be connected through the shower hose 18 directly to the water source. The sump-pump 19 discharges waste water accumulating in the bottom of the basin panel 11 through an outlet hose 21 to a sink or bathtub (not shown). Three adjustable leveling supports 22 are located below three corners of the basin panel 11, excluding only the corner occupied by the sump-pump 19. The adjustable leveling supports 22 are used to establish a slight incline of the bottom of the basin panel 11 toward the sump-pump 19, so that the accumulating waste water flows in that direction.

The sump-pump 19 may be driven by an internal electric motor or by the incoming pressure from the water source. For ease of cleaning, in the preferred embodiment the sump-pump 19 is removable from the basin panel 11 and is attached to the floor of the basin panel 11 by a key-groove or threaded flange connection (not shown).

The length of the shower hose 18 is sufficient to extend above the level of the shower curtain rod 16, so that the caregiver can direct the spray from the shower head 17 downward on the patient from outside the portable shower stall 10. The flow and intensity of the shower spray is controlled by a button or knob 23 on the shower head 17. A hook or clip 24 is provided on the shower head 17 by which it may be suspended from the shower curtain rod 16, thus freeing the hands of the caregiver to wash the patient.

The back panel 12 is connected to the rear of the basin panel 11 by two or more hinges 25. These hinges 25 allow the back panel 17 to be raised to an upright position, as shown in FIG. 1, or lowered to a closed position, as shown in FIG. 3. When the portable shower stall 10 is disassembled, the tubular members of the vertical poles 14 and the shower curtain rod 16 are stored inside the basin panel 11, along with the shower head 17, the shower hose 18, the sump-pump 19, the inlet hose 20, the outlet hose 21, and a shower curtain 31. The back panel 12 is then closed and is held in the closed position against the basin panel 11 by a latch mechanism 26. To facilitate transport of the portable shower stall 10, a handle 27 is provided on the outside of one wall of the basin panel 11, and one or more trundle wheels 28 are affixed to the outer corners of the opposite side of the basin panel 11.

When it is lifted to the upright position, the back panel 12 functions as a partial back wall of the portable shower stall 10. In the preferred embodiment, one or more towel bars 29 and soap/shampoo holders 30 are incorporated in the back panel 12, where they may be accessed by the caregiver.

Figure 2:
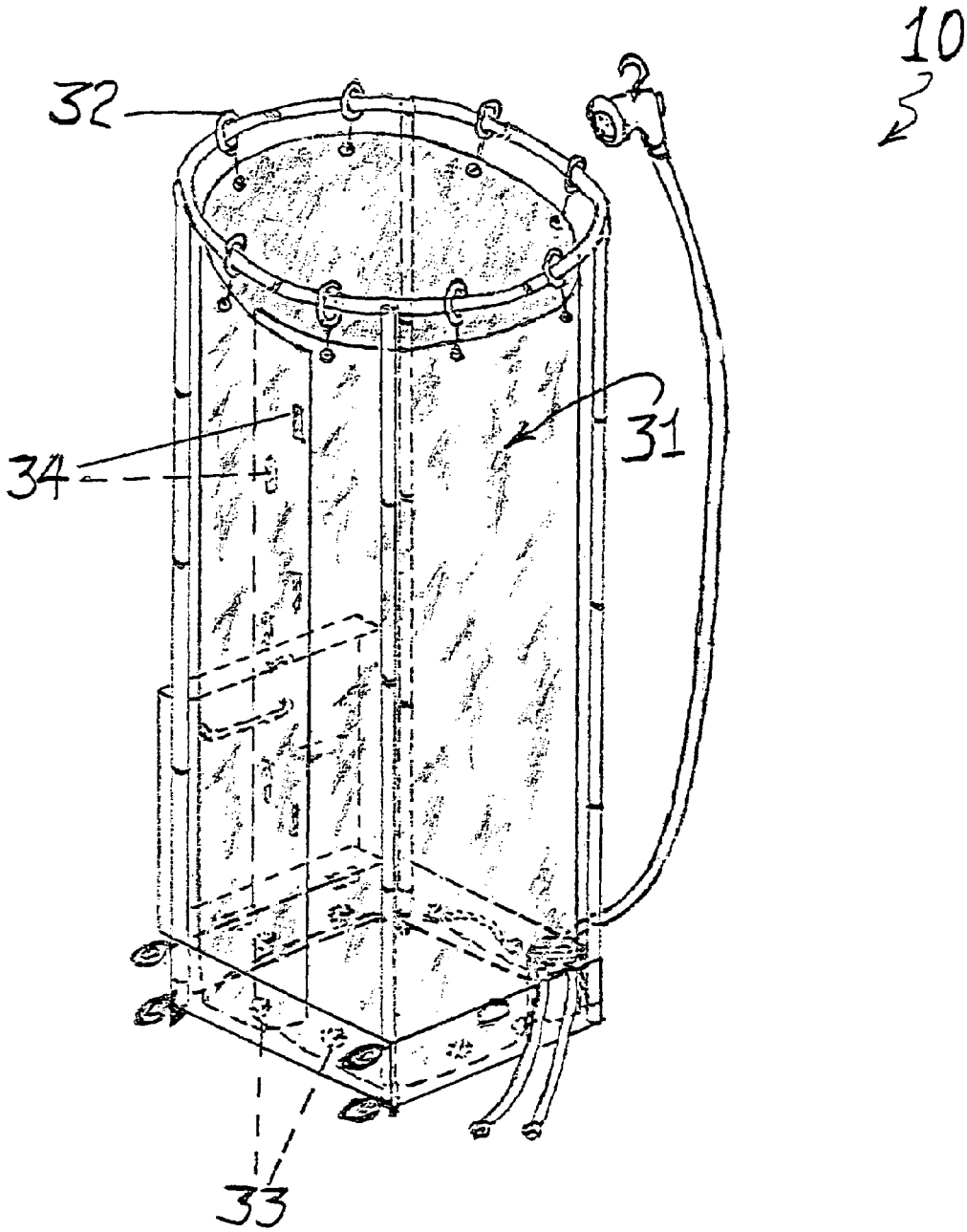
FIG. 2 is an isometric view of the portable shower stall in its expanded form with the shower curtain installed.

After the portable shower stall 10 has been assembled, a shower curtain 31 is hung from the shower curtain rod 16 by a number of shower curtain rings 32, as shown in FIG. 2. The shower curtain 31 contains a number of eyelets on its upper and lower borders. The upper eyelets accommodate the shower curtain rings 32, while the lower eyelets connect to corresponding hooks 33 located in the interior walls of the basin panel 11. In this manner, the shower curtain 31 is secured inside the basin panel 11, thereby preventing water from dripping outside the portable shower stall 10. As shown in FIG. 2, the shower curtain 31 wraps around the shower enclosure and closes back on itself, with two or more corresponding velcro strips 34 on each flap serving to seal the enclosure. When the shower curtain 31 is closed, the back panel 12 remains outside the shower enclosure, thereby allowing the caregiver to access the towel bar 29 and soap/shampoo holder 30 without getting wet.

The present invention 10 is, therefore, well suited to satisfy the need for a portable shower stall which may be used by a caregiver administering a shower to an invalid patient and may be readily and compactly stowed away when not in use.

While the present invention has been described in some detail with reference to certain currently preferred embodiments, other embodiments are feasible and will readily suggest themselves to those skilled in the art. Therefore, the spirit and scope of the appended claims are not limited to the description of the preferred embodiment contained herein.

What is claimed is:

1. A portable shower stall comprising:

(a) a basin panel consisting of a water-tight rectangular enclosure having a flat bottom and four vertical walls;

(b) a back panel hingeably attached to the rear wall of the basin panel, said back panel consisting of a water-tight rectangular enclosure having the same length and width dimensions as the basin panel, such that when the back panel is in the closed position, it forms a suitcase-like enclosure with the back panel;

(c) four segmented vertical poles which are insertable into four basin sockets located in the corners of the basin panel and support a shower curtain rod;

(d) a shower curtain which is suspendable from the shower curtain rod by multiple rings or hooks attachable to multiple eyelets distributed along its upper border, and which can be secured to multiple hooks along the interior walls of the basin panel through multiple eyelets distributed along its lower border;

(e) a shower head having a flow-control button or knob, which shower head is connected through a shower hose to a sump-pump located in one corner of the basin panel;

(f) an inlet hose which connects the sump-pump to a water source, and an outlet hose through which the sump-pump can discharge waste water accumulated in the basin panel to a sink or bathtub;

(g) three adjustable leveling supports located below the exterior side of three corners of the basin panel, excluding the corner occupied by the sump-pump, whereby the bottom of the basin panel can be inclined in the direction of the sump-pump so that waste water flows toward the sump-pump;

(h) a latch mechanism securing the basin panel to the back panel when the latter is in the closed position, thereby creating a secure suitcase-like enclosure within which can be stored the disassembled components of the portable shower stall for ease of transport and storage when not in use.

2. The portable shower stall according to claim 1, wherein the shower head is provided with a hook or clip by which it may be suspended from the annular curtain rod.

3. The portable shower stall according to claim 2, wherein the sump-pump is detachable from the basin panel for ease of cleaning and maintenance.

4. The portable shower stall according to claim 3, wherein the shower curtain is provided with multiple corresponding velcro strips at either end, whereby the two end flaps of the shower curtain may be joined together to seal the shower enclosure.

5. The portable shower stall according to claim 4, wherein the back panel is provided with one or more towel bars and soap/shampoo holders.

6. The portable shower stall according to any of claims 1 through 5, further comprising a handle located on the exterior of one wall of the basin panel to facilitate transport of the disassembled portable shower stall in its suitcase-like enclosure.

7. The portable shower stall according to claim 6, further comprising a trundle wheel affixed to the exterior of one of the corners of the basin panel opposite the handle, thereby further facilitating transport of the suitcase-like enclosure.

8. A portable shower stall comprising:

(a) a basin panel consisting of a water-tight rectangular enclosure having a flat bottom and four vertical walls;

(b) a back panel hingeably attached to the rear wall of the basin panel, said back panel consisting of a water-tight rectangular enclosure having the same length and width dimensions as the basin panel, such that when the back panel is in the closed position, it forms a suitcase-like enclosure with the back panel;

(c) four segmented vertical poles which are insertable into four basin sockets located in the corners of the basin panel and support a shower curtain rod;

(d) a shower curtain which is suspendable from the shower curtain rod by multiple rings or hooks attachable to multiple eyelets distributed along its upper border, and which can be secured to multiple hooks along the interior walls of the basin panel through multiple eyelets distributed along its lower border;

(e) a shower head having a flow-control button or knob, which shower head is connected through a shower hose to a water source;

(f) a sump-pump located in one corner of the basin panel, which sump-pump is connected to an outlet hose through which the sump-pump can discharge waste water accumulated in the basin panel to a sink or bathtub;

(g) three adjustable leveling supports located below the exterior side of three corners of the basin panel, excluding the corner occupied by the sump-pump, whereby the bottom of the basin panel can be inclined in the direction of the sump-pump so that waste water flows toward the sump-pump;

(h) a latch mechanism securing the basin panel to the back panel when the latter is in the closed position, thereby creating a secure suitcase-like enclosure within which can be stored the disassembled components of the portable shower stall for ease of transport and storage when not in use.

9. The portable shower stall according to claim 8, wherein the shower head is provided with a hook or clip by which it may be suspended from the annular curtain rod.

10. The portable shower stall according to claim 9, wherein the sump-pump is detachable from the basin panel for ease of cleaning and maintenance.

11. The portable shower stall according to claim 10, wherein the shower curtain is provided with multiple corresponding velcro strips at either end, whereby the two end flaps of the shower curtain may be joined together to seal the shower enclosure.

12. The portable shower stall according to claim 11, wherein the back panel is provided with one or more towel bars and soap/shampoo holders.

13. The portable shower stall according to any of claims 8 through 12, further comprising a handle located on the exterior of one wall of the basin panel to facilitate transport of the disassembled portable shower stall in its suitcase-like enclosure.

14. The portable shower stall according to claim 13, further comprising one or more trundle wheels affixed to the exterior of one or more of the corners of the side of the basin panel opposite the handle, thereby further facilitating transport of the suitcase-like enclosure.

* * * * *